US009126255B2

(12) United States Patent
Yagi et al.

(10) Patent No.: US 9,126,255 B2
(45) Date of Patent: Sep. 8, 2015

(54) PRESS DIE FOR METAL PLATE MOLDING, THE PROCESSING METHOD OF THE SURFACE OF THE PRESS DIE, AND MANUFACTURING METHOD OF A VEHICLE BODY

(75) Inventors: Takayuki Yagi, Tokyo (JP); Akihiro Matsuyama, Tokyo (JP); Shinichi Koyama, Tokyo (JP); Masato Fukushima, Tokyo (JP); Kinji Takahashi, Tokyo (JP); Kazumichi Tosa, Tokyo (JP); Masashi Seino, Tokyo (JP); Takeshi Terada, Tokyo (JP); Yuu Yamakawa, Tokyo (JP); Motoo Takano, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 724 days.

(21) Appl. No.: 12/677,229

(22) PCT Filed: Jul. 31, 2008

(86) PCT No.: PCT/JP2008/064169

§ 371 (c)(1),
(2), (4) Date: Mar. 9, 2010

(87) PCT Pub. No.: WO2009/054175

PCT Pub. Date: Apr. 30, 2009

(65) Prior Publication Data

US 2010/0206037 A1 Aug. 19, 2010

(30) Foreign Application Priority Data

Oct. 24, 2007 (JP) ..... 2007-276524
Nov. 5, 2007 (JP) ..... 2007-287839
Nov. 30, 2007 (JP) ..... 2007-311351

(51) Int. Cl.
*B21D 37/00* (2006.01)
*B21D 37/20* (2006.01)

(Continued)

(52) U.S. Cl.
CPC . *B21D 37/20* (2013.01); *B24C 1/00* (2013.01); *C25D 3/04* (2013.01); *C25D 5/16* (2013.01); *C25D 5/34* (2013.01); *C25D 5/48* (2013.01); *C25D 5/52* (2013.01)

(58) Field of Classification Search
CPC ..... B21C 23/22; B21C 3/18; B24C 1/10; B24C 1/00; D21G 1/00; D21D 37/20; D21D 37/205; D01D 4/022; C21D 7/06; B21D 37/20; C25D 5/34; C25D 5/16; C25D 5/52; C25D 5/48; C25D 3/04
USPC ..... 72/47, 53; 29/90.7, 90.1; 76/107.1, 76/107.4, 107.6, 107.8
See application file for complete search history.

(56) References Cited

U.S. PATENT DOCUMENTS 1,688,060 A * 10/1928 Schwartz ..... 264/338
2,248,530 A * 7/1941 Granger et al. ..... 384/13

(Continued)

FOREIGN PATENT DOCUMENTS

DE 21 21 010 A1 11/1972
EP 0418893 A2 3/1991

(Continued)

OTHER PUBLICATIONS

JP-52014707 date of patent Apr. 23, 1977; Translation U.S. Patent office Dec. 2012.*

(Continued)

*Primary Examiner* — Shelley Self
*Assistant Examiner* — Lawrence Averick
(74) *Attorney, Agent, or Firm* — Rankin, Hill & Clark LLP

(57) ABSTRACT

A press die and a processing method of the press die surface, and a manufacturing method of a vehicle body of an automobile, are capable of maintaining a high non-defective product rate of works after press processing, even in a case in which foreign matter such as iron filings and the like have adhered to a die surface. A press die for sheet metal forming has a multitude of concave portions on a die surface, and has a roughness (Ry) of a die surface on which the multitude of concave portions has been formed of 30 to 38 μm.

4 Claims, 12 Drawing Sheets

(51) Int. Cl.

| | |
|---|---|
| ***C25D 3/04*** | (2006.01) |
| ***C25D 5/16*** | (2006.01) |
| *B24C 1/00* | (2006.01) |
| *C25D 3/00* | (2006.01) |
| *C25D 5/00* | (2006.01) |
| *C25D 5/34* | (2006.01) |
| *C25D 5/48* | (2006.01) |
| *C25D 5/52* | (2006.01) |

(56) References Cited

U.S. PATENT DOCUMENTS

| | | | | |
|---|---|---|---|---|
| 2,736,670 | A * | 2/1956 | Griffiths | 148/286 |
| 3,787,191 | A * | 1/1974 | Duncan | 428/687 |
| 4,235,583 | A * | 11/1980 | Reed | 425/464 |
| 4,581,913 | A * | 4/1986 | Reed | 72/53 |
| 5,921,126 | A * | 7/1999 | Miller | 72/42 |
| 6,444,259 | B1 * | 9/2002 | Subramanian et al. | 427/191 |
| 6,572,742 | B1 * | 6/2003 | Cohen | 204/297.05 |
| 6,807,838 | B2 * | 10/2004 | Iwaya | 72/350 |
| 2002/0139164 | A1 * | 10/2002 | Ishihara | 72/326 |
| 2005/0252262 | A1 * | 11/2005 | Imai et al. | 72/47 |
| 2007/0017272 | A1 * | 1/2007 | Kurisu et al. | 72/342.2 |
| 2007/0138157 | A1 * | 6/2007 | Dane et al. | 219/121.85 |
| 2008/0098788 | A1 * | 5/2008 | Taniguchi et al. | 72/336 |
| 2008/0223099 | A1 * | 9/2008 | David | 72/53 |

FOREIGN PATENT DOCUMENTS

| | | | |
|---|---|---|---|
| EP | 0 798 095 | A1 | 10/1997 |
| EP | 1 466 679 | A2 | 10/2004 |
| GB | 1 327 873 | A | 8/1973 |
| JP | 49-011767 | | 2/1974 |
| JP | 52-014707 | B | 4/1977 |
| JP | 63-138924 | | 9/1988 |
| JP | 03-138032 | A | 6/1991 |
| JP | 6-262689 | | 9/1994 |
| JP | 8-000263 | B | 1/1996 |
| JP | 08-155966 | A | 6/1996 |
| JP | 09-239739 | A | 9/1997 |
| JP | 09-262837 | A | 10/1997 |
| JP | 11-320627 | A | 11/1999 |
| JP | 2001-301652 | | 10/2001 |
| JP | 2004-154998 | | 6/2004 |
| JP | 2007-178719 | | 7/2007 |

OTHER PUBLICATIONS

European Office Action, EP Application No. 08792276.1, mailed Nov. 25, 2011, 5 pages.

* cited by examiner

PRESS DIE FOR METAL PLATE MOLDING, THE PROCESSING METHOD OF THE SURFACE OF THE PRESS DIE, AND MANUFACTURING METHOD OF A VEHICLE BODY

TECHNICAL FIELD

The present invention relates to a press die for sheet metal forming, a processing method of a surface of the press die, and a manufacturing method of a vehicle body.

BACKGROUND ART

Conventionally, forming of outer panel components of an automobile and the like have been carried out by press forming, in which a work is press processed using a press die. Generally, it is preferred that a press die used in a press process be such that the die surface, which is a contact surface with a work in the press die, be smoothed. By smoothing the die surface, it is possible to increase surface precision of a work (outer panel components) formed.

As a method for smoothing a die surface, the applicant proposes a processing method of a die surface and a die for which the processing method has been applied (see Patent Document 1) in which, first, a forming surface of a die is formed by a cutting process, then a synthetic resin is applied to the formed die surface, and next shot blasting is performed for smoothing a shape of the die surface. According to a method described in Patent Document 1, by a cutting process, it is possible effectively to grind high spots that are leftover from cutting generated on a die surface, thereby efficiently carrying out smoothing of a die surface.

Patent Document 1: Japanese Examined Patent Application Publication No. Hei 8-263

DISCLOSURE OF THE INVENTION

Problems to be Solved by the Invention

However, in the press die described in Patent Document 1, in a case of repeatedly carrying out a press process in which foreign material of iron dust or other foreign particles or the like have adhered to the surface of the press die, large irregularities were formed on the surface of the work after a press process, having arisen from the foreign material (see FIG. 13), and these eventually became a problem for quality of the product. In other words, there is a problem in that, as a press process is repeated, foreign material of iron dust or the like becomes caught in the surface of the press die, and the incidence rate of defective products becomes higher.

Therefore, the present invention has the objective of providing a press die for sheet metal forming, a processing method of a surface of the press die, and a manufacturing method of a vehicle body, capable of maintaining a high rate of non-defective works after a press process.

Means for Solving the Problems

The present inventors discovered that, by forming a multitude of concave portions of prescribed depth in a die surface, it was possible to achieve the above-mentioned objective, and this lead to completing the present invention. More specifically, the present invention provides the following.

According to a first aspect, a press die for sheet metal forming has a multitude of concave portions in a die surface, in which a roughness (Ry) of the die surface is 30 to 38 μm.

According to a second aspect, the press die for sheet metal forming as described in the first aspect has a plated layer on the die surface.

According to a third aspect, in the press die for sheet metal forming as described in the second aspect, the plated layer has a thickness of 5 to 30 μm.

According to a fourth aspect, in the press die for sheet metal forming as described in the second or third aspect, the plated layer is formed by electroplating.

According to a fifth aspect, in the press die for sheet metal forming as described in the fourth aspect, the electroplating is chrome plating.

According to a sixth aspect, in a press die for sheet metal forming, in a die having a plated layer, a roughness (Ry) of the die surface is 30 to 38 μm.

According to a seventh aspect, in a processing method of a surface of a press die for sheet metal forming, a shot blast process is performed on the surface of the press die, forming a multitude of concave portions, and then a polishing process is performed on the surface of the press die to which a shot blast process was performed, to make a roughness (Ry) on the surface of the press die be 30 to 38 μm.

According to an eighth aspect, in the processing method of a surface of a press die for sheet metal forming as described in the seventh aspect, prior to performing the shot blast process, plating processing is performed on the press die surface.

According to a ninth aspect, a press die has had surfacing processing performed by way of the processing method of the surface of the press die for sheet metal forming as described in the seventh or eighth aspect.

According to a tenth aspect, a maintenance method of the die surface in the press die for sheet metal forming as described in any one of the second to sixth aspects, the maintenance method includes: a step of removing the plated layer, a step of forming a new plated layer on the die surface from which the plated layer was removed, a step of forming a multitude of concave and convex portions by performing a shot blast process on the new plated layer, and a step of performing polishing processing on the new plated layer on which the multitude of concave and convex portions has been formed, to make a roughness (Ry) of the die surface be 30 to 38 μm.

According to an eleventh aspect, a press die for sheet metal forming has a curved surface portion in which a die surface is formed of a curved surface and a substantially planar surface portion in which a die surface is formed of a substantially planar surface, in which a multitude of concave portions has been formed only on the die surface in the substantially planar surface portion.

According to a twelfth aspect, in the press die for sheet metal forming as described in the eleventh aspect, the die surface in the curved surface portion has a radius of curvature of no greater than 5 mm, and the die surface in the substantially planar surface portion has a radius of curvature of greater than 5 mm.

According to a thirteenth aspect, in the press die for sheet metal forming as described in the eleventh or twelfth aspect, a roughness (Ry) is 30 to 38 μm in the die surface of the substantially planar surface portion in which the multitude of concave portions has been formed.

According to a fourteenth aspect, in the press die for sheet metal forming as described in any of the eleventh to thirteenth aspects, the die surface in the curved surface portion and the substantially planar surface portion has a plated layer.

According to a fifteenth aspect, in the press die for sheet metal forming as described in the fourteenth aspect, the plated layer has a thickness of 5 to 30 μm.

According to a sixteenth aspect, in the press die for sheet metal forming as described in the fourteenth or fifteenth aspect, the plated layer is formed by electroplating.

According to a seventeenth aspect, in the press die for sheet metal forming as described in the sixteenth aspect, the electroplating is chrome plating.

According to an eighteenth aspect, a press die for sheet metal forming is characterized in that, in the press die for sheet metal forming including a three-dimensional die surface having a curved surface portion and a substantially planar surface portion, a shot blast process is performed on the substantially planar surface portion to exclude the curved surface portion, thereby forming a multitude of concave portions.

According to a nineteenth aspect, a surface processing method of a press die for sheet metal forming has a curved surface portion in which the die surface is formed of a curved surface and a substantially planar surface portion in which the die surface is formed of a substantially planar surface, including a shot blast process step of forming a multitude of concave portions by performing a shot blast process on only the die surface in the substantially planar surface portion.

According to a twentieth aspect, the surface processing method for a press die for sheet metal forming as described in the nineteenth aspect includes a polishing process step of performing a polishing process on the die surface on which the multitude of concave portions has been formed in the shot blast process step, after the shot blast process step.

According to a twenty-first aspect, the surface processing method of a press die for sheet metal forming as described in the twentieth aspect is characterized in that in the polishing process step, a roughness (Ry) in the die surface of the substantially planar surface portion in which the multitude of concave portions has been formed has been adjusted to be 30 to 38 μm.

According to a twenty-second aspect, the surface processing method of a press die for sheet metal forming as described in the twentieth or twenty-first aspect includes, before the shot blast process step, a masking step of performing masking processing on at least the die surface in the curved surface portion.

According to a twenty-third aspect, the processing method of a surface of a press die for sheet metal forming as described in the twenty-second aspect includes, before the masking step, a plating step of performing plating processing on a surface of the press die.

According to a twenty-fourth aspect, a press die for sheet metal forming has had surface processing performed thereto by a processing method of a press die surface for sheet metal forming as described in any one of the nineteenth to twenty-third aspects.

According to a twenty-fifth aspect, a maintenance method of a die surface in a press die for metal, as described in any one of the fourteenth to seventeenth aspects, includes a plated layer removal step of removing the plated layer; a re-plating step of forming a new plated layer on the die surface in the curved surface portion and the substantially planar surface portion from which the plated layer was removed in the plated layer removal step; a masking step of performing masking processing at least on the die surface of the curved surface portion in the new plated layer formed in the re-plating step; a shot blast process step of, after the masking step, performing a shot blast process on at least one portion on the die surface of the substantially planar surface portion, thereby forming a multitude of concave and convex portions; and a polishing process step of performing a polishing process on the new plated layer on the die surface on which the multitude of concave and convex portions has been formed.

According to a twenty-sixth aspect, a manufacturing method of a vehicle body includes a forming step of forming outer panel components of a vehicle body using a press die for sheet metal forming as described in any one of the first to sixth aspects and the eleventh to eighteenth aspects, and a welding step of welding at least one outer panel component formed in the forming step, thereby constructing an entirety of a vehicle body.

According to a twenty-seventh aspect, a manufacturing method of industrial products includes a step of manufacturing a work by forming a sheet member using a press die for sheet metal forming as described in any of the first to sixth and eleventh to eighteenth aspects, and a welding step of manufacturing major components of industrial goods by welding a plurality of the work.

Effects of the Invention

According to a processing method of a press die for sheet metal forming and a press die surface of the present invention, since a die surface has a multitude of concave portions of prescribed depth, even in a case in which such foreign matter as iron dust and the like adhere to the die surface, large concave and convex portions are not formed on the work after a press process, and it is possible to maintain a high rate of non-defective works after the press process.

EXPLANATION OF REFERENCE NUMERALS

1 Press Die
2 Die Surface
3 Concave Portion
4 Foreign Matter
5 Work
6 Plated Layer
7 Deformity
8 Injector
9 Masking Member
11 Curved Surface Portion
12 Substantially Planar Surface Portion

PREFERRED MODE FOR CARRYING OUT THE INVENTION

Below, the present invention is explained based on a first embodiment, which is one preferred embodiment, with reference to FIG. 1.

Figure 1:
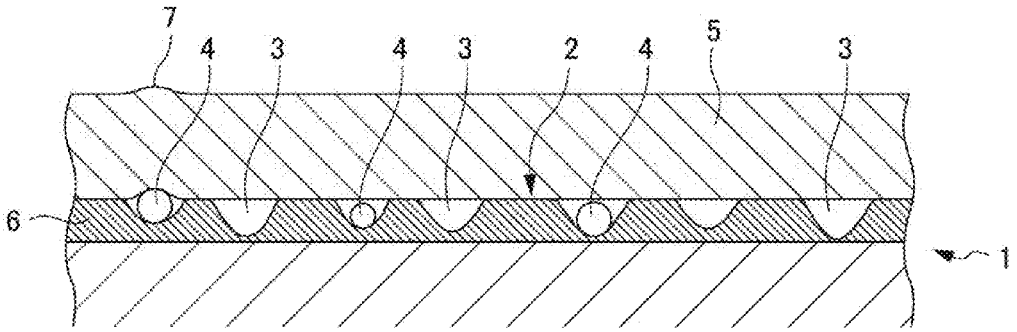
FIG. 1 is a view illustrating a state of carrying out a press process using a press die of the present invention.

FIG. 1 is a view illustrating a state of carrying out a press process using a press die for sheet metal forming of the present invention.

A press die for sheet metal forming (hereafter referred to as just "press die" as well) 1 of the first embodiment, as illustrated in FIG. 1, has a multitude of concave portions 3 in a die surface 2. Furthermore, a roughness (Ry) of a die surface 2 on which this multitude of concave portions 3 has been formed is within a range of 30 to 38 μm.

Moreover, "roughness" in the present specification refers to "surface roughness" as stipulated in JIS B0601-1994, and "(Ry)" indicates a height from a lowest valley to a highest peak for each reference length: a maximum height.

In the present invention, by a die surface 2 having a multitude of concave portions 3, even in a case in which a fine foreign matter 4 of iron dust and the like becomes caught in a die surface 2, because the foreign matter 4 enters into the concave portions 3, large concave and convex portions do not form in the work surface after a press process. Moreover, as the foreign matter 4 adhering to the die surface 2, aside from the abovementioned iron dust, waste fibers or flakes of coating and the like can be given.

Furthermore, by setting the roughness (Ry) of the die surface 2 in which the multitude of concave portions 3 is formed to within a range of 30 to 38 μm, it is possible to prevent a reduction in surface precision of a work 5 after a press process due to existence of the multitude of concave portions 3, while being able to prevent formation of large concave and convex portions on a surface of the work 5 after a press process, even in a case of adherence of relatively large-sized foreign matter 4.

More specifically, in a case in which the foreign matter 4 is iron dust, even at a time of adherence of iron dust of particle size of a maximum of approximately 15 μm on a die surface, a height of concave and convex portions (hereafter referred to as "deformity 7" as well) formed on a surface of a work 5 after a press process can be limited to approximately 9 μm. Furthermore, in a case in which the foreign matter 4 is ordinary dirt other than iron dust, even in a case of foreign matter 4 of particle size of a maximum of approximately 25 μm adhering on a die surface, a height of a deformity 7 formed on a surface of a work 5 after a press process can be limited to approximately 9 μm.

Ordinarily, in a case in which a deformity 7 formed on a surface of a work 5 after a press process is less than 10 μm, it is difficult to confirm the existence of the deformity 7 visually, and a formed work 5 is assumed to be non-defective. On the other hand, in a case in which a deformity 7 is at least 10 μm, the existence of the deformity 7 is confirmed visually, a formed work 5 is assumed defective, and repair work in which the deformity 7 is ground becomes necessary.

Therefore, as described above, according to the press die 1 of the present embodiment, in which a multitude of concave portions 3 is formed on a die surface 2, and a roughness (Ry) of the die surface 2 formed by this multitude of concave portions 3 is set to be 30 to 38 μm, it is possible to maintain a high rate of non-defective products, even when foreign matter 4 adheres onto the die surface 2.

Furthermore, because in many cases, repair work of defective products is carried out by hand, necessitating much labor and cost, by the formed works 5 maintaining a high rate of non-defective products, it is possible to attempt to improve manufacturing efficiency in a press process step while reducing cost.

Moreover, in a case in which a roughness (Ry) of the die surface 2 is less than 30 μm, in a case where foreign matter 4 cuts in, a large deformity 7 is formed after a press process, and the rate of non-defective products of works 5 is lowered. In a case in which a roughness (Ry) of the die surface 2 is greater than 38 μm, due to the presence of the multitude of concave portions 3 thus formed, surface precision of the works 5 after the press process is lowered.

As a method for forming a multitude of concave portions 3 on the die surface 2, for example, a method may be given in which, after performing a shot blast process to the die surface 2 and forming a multitude of concave and convex portions, a polishing process is performed to the die surface 2, and a roughness (Ry) of the die surface 2 in which the multitude of concave portions 3 has been formed is adjusted to be 30 to 33 μm (details to be described later).

Furthermore, using a roller (not illustrated) including a multitude of concave and convex portions of a prescribed depth in forming a multitude of concave portions 3 on the die surface 2 also acceptable.

As illustrated in FIG. 1, a press die 1 having a plated layer is preferred. In other words, it is preferable that a plated layer 6 be formed on the die surface 2. By the plated layer 6 being formed on the die surface 2, strength of the die surface 2 is increased, increasing abrasion resistance of a press die 1. Furthermore, it is also possible to increase corrosion resistance of the press die 1, thereby lengthening a usable life of the press die 1.

The plated layer 6 may be formed by electroplating such as industrial chrome plating, nickel-tungsten plating, dispersion nickel plating, or rhodium plating, or by such electroless plating as electroless nickel plating, and in particular, it is preferable, from a durability perspective, to form thereof by industrial chrome plating. A thickness of the plated layer 6, from a perspective of durability and reliability as an industrial plating, would preferably be 5 to 30 μm, and more preferably 15 to 25 μm.

Moreover, even when the present invention is applied to a die for which plating processing has not been applied, the effect is the same.

Figure 2A:
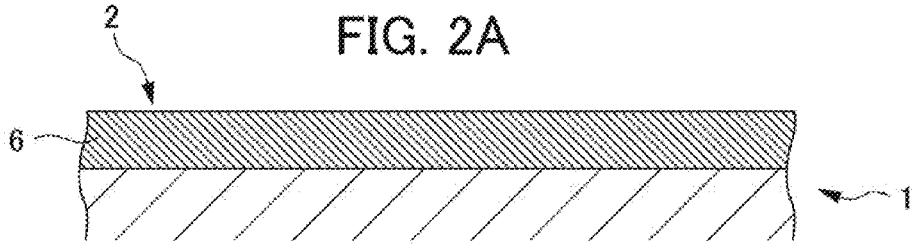
FIG. 2A is a view illustrating a state in which plating process has been performed in a processing method of a press die surface of a first embodiment.
Figure 2B:
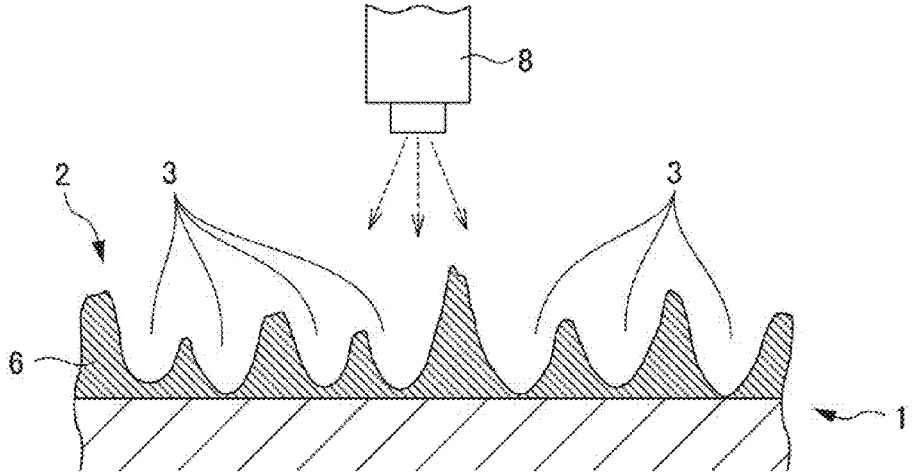
FIG. 2B is a view illustrating a state in which a shot blast process has been performed in a processing method of a press die surface of the first embodiment.
Figure 2C:
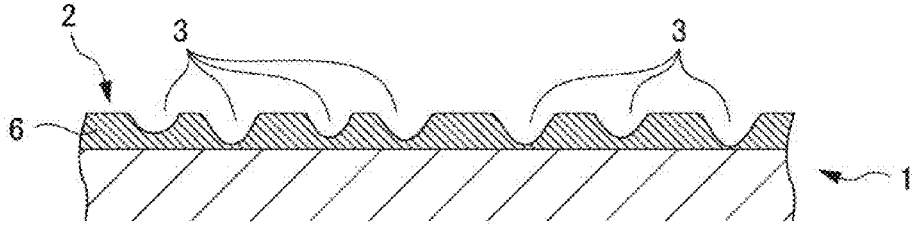
FIG. 2C is a view illustrating a state in which a polishing process has been performed in a processing method of a press die surface of the first embodiment.

Next, a processing method of a press die surface of a first embodiment is explained with reference to FIGS. 2A to 2C. FIGS. 2A to 2C are views illustrating each step in a processing method of a press die surface of a first embodiment.

A processing method of a press die surface of a first embodiment includes 1) a plating processing step, 2) a shot blast process step, and 3) a polishing process step.

1) Plating Processing Step

First, plating processing is performed on a die surface 2, which is a contact surface with a work in a press die 1 (see FIG. 2A). The plating processing, for example, can be carried out by a processing method of industrial chrome plating, which is a common electroplating, and a plated layer 6 is formed on the die surface 2 by the plating method.

For the press die 1, for example, it is possible to use such cast-iron dies as FC250, FC300, FCD500, and the like.

2) Shot Blast Process Step

Next, a shot blast process is performed on the die surface 2 on which plating processing has been applied (see FIG. 2). By a shot blast process, a multitude of concave and convex portions is formed on the die surface. The shot blast process, as illustrated in FIG. 2B, is carried out by spraying shot blasting media of a prescribed particle diameter from an injection device 8 onto a die surface 2 after the plating process. As shot blasting media used in the shot blast process, for example, it is possible to use glass beads, aluminum beads, ceramic beads, and the like. Furthermore, a particle diameter of shot blasting media, from a perspective of forming a concave portion 3 of preferable depth, is preferably 0.1 to 0.3 mm. In addition, a shot blasting pressure in the shot blast process, also from a perspective of forming a concave portion 3 of preferable depth, is preferably 0.5 to 1.2 MPa.

Moreover, here, a roughness (Ry) of a die surface 2 in which a multitude of concave portions 3 is formed after the shot blast process, from a perspective of assuming a roughness (Ry) of the die surface 2 after a polishing step (after final finishing) to be described later to be 30 to 38 μm, is 35 to 43 μm. In other words, in a polishing step after a shot blast process, approximately 5 μm is planed from the overall die.

3) Polishing Process Step

Next, a polishing process is performed to the die surface on which a multitude of concave portions 3 has been formed by a shot blast process (see FIG. 2C). By performing this polishing process, a shape of a peak part of a convex portion formed between two concave portions 3 and 3 adjacent to each other is flattened, while a roughness (Ry) of the die surface 2 on which a multitude of concave portions 3 is formed is adjusted to be within a range of 30 to 38 μm. In this way, by flattening peak parts of convex portions, a surface precision of a work 5 after a press process is further increased. The polishing process can be carried out using a file or the like; for example, 600 to 800 grain sandpaper can be used. Moreover, in the polishing process step, it is acceptable to adopt a polishing method other than sandpaper.

By way of this polishing process, it is preferable to finish the die surface 2 so that the roughness (Ry), which is a concave/convex average, is 35 μm.

According to a processing method of a press die surface of the first embodiment, since a multitude of concave portions 3 having prescribed depth is formed on the die surface 2, even in a case in which such foreign matter 4 as iron dust or the like become adhered onto the die surface 2, it is possible to obtain a press die 1 which can maintain a high non-defective product rate of works 5 after the press process.

Furthermore, by performing a shot blast process after performing plating processing to the die surface 2, plating hardness is increased and, consequently, abrasion-resistance of the press die 1 is increased.

Furthermore, according to a processing method of a press die surface of the first embodiment, since a die can have a plated layer by having a plating processing step, a multitude of concave portions is formed on a plated layer part of a die surface. Therefore, in a case in which a die is used repeatedly in a press process and a roughness (Ry) of a die surface becomes outside a range of 30 to 38 μm, it is possible to recover a roughness (Ry) of a die surface easily by removing a plated layer, and performing re-plating processing, a shot blast process, and a polishing process.

In ocher words, according to a press die which has had surface processing applied by a processing method of a press die surface of the first embodiment, it is possible easily to carry out maintenance for preserving a roughness (Ry) of a die surface to within a prescribed range.

Moreover, a deterioration measurement of a roughness (Ry) of a die surface can easily be measured using a surface roughness measuring instrument to be described later. Furthermore, removal of a plated layer can be carried out, for example, by soaking a die having a plated layer in a solution such as acid or the like.

It is desirable appropriately to carry out maintenance of a die surface while using a measured value of roughness (Ry) by a suitable surface roughness measuring instrument as a reference. However, it is possible to carry out maintenance with a number of presses (number of shot blastings), an operating time of a die, and a frequency of debris getting caught as control items.

Processing of a press die in a first embodiment can be performed to an entire surface of the die surface 2, but it is preferable to be performed especially on flat surfaces for which the presence of deformities 7 after a press process is easily visually recognized, that is, only to regions of a low degree of curvature at a time of a press process. Regions of a low degree of curvature can have deformities 7 after a press process easily recognized, but on the other hand, force applied to a the die surface 2 at a time of a press process is relatively small compared to regions of a high degree of curvature. As a result, by forming a multitude of concave portions 3 only on regions of a low degree of curvature, wear on shapes if concave portions 3 becomes less, and it is possible to lengthen a usable life of a press die.

It is possible preferably to use a press die for which the processing method of the press die surface of the above-mentioned first embodiment has been performed on a shape for an outer panel component of a vehicle body of an automobile or the like. Furthermore, identical results were obtained whether the outer panel component was iron or aluminum.

Next, a second embodiment of the present invention is explained with reference to FIGS. 3A to 5.

Figure 3A:
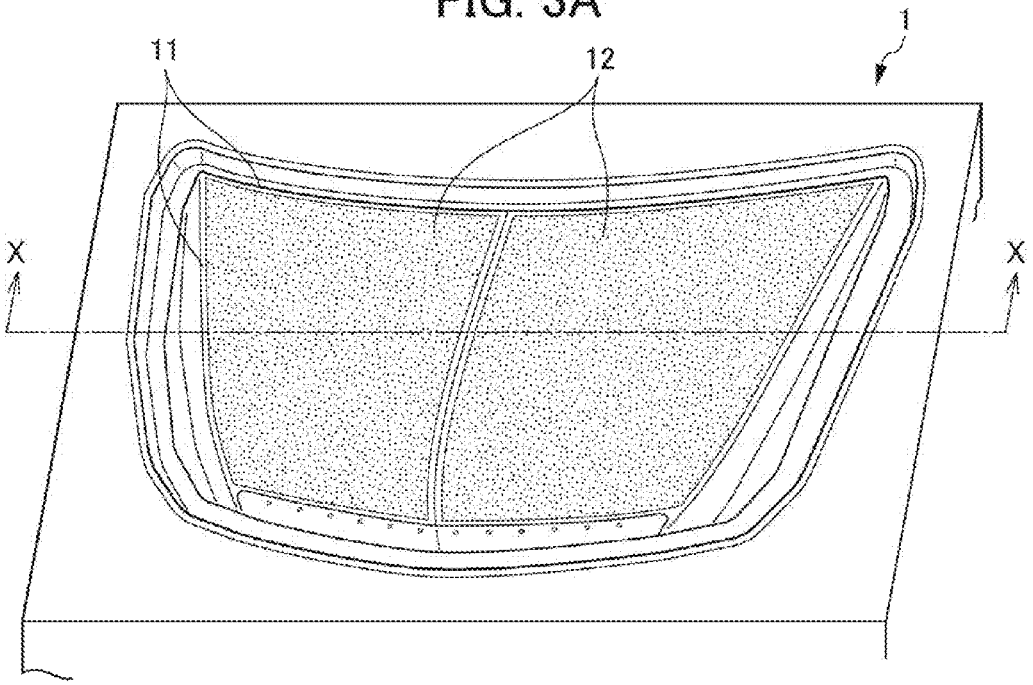
FIG. 3A is a perspective view illustrating a press die for sheet metal forming of the first embodiment, and illustrates a press die for automobile hood manufacturing.
Figure 3B:
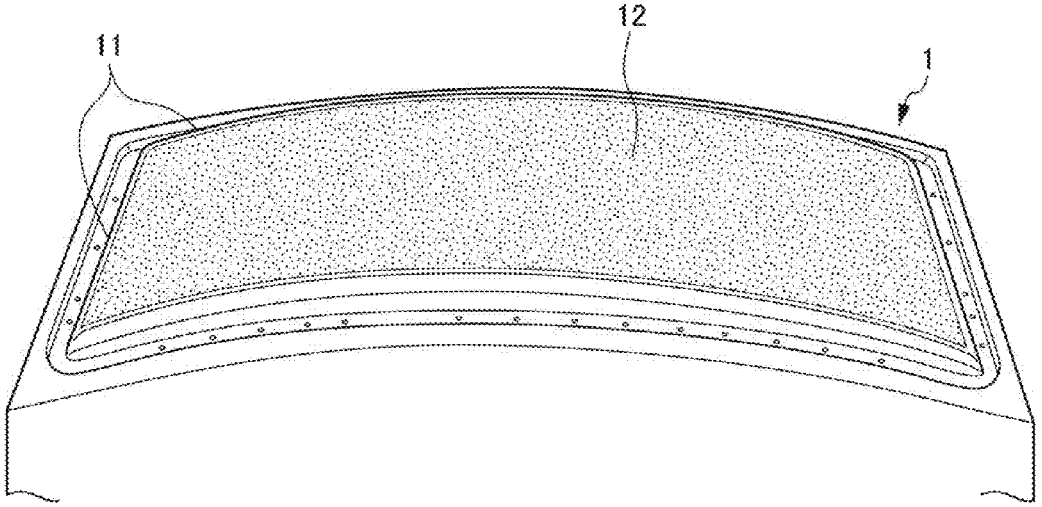
FIG. 3B is a perspective view illustrating a press die for sheet metal forming of the first embodiment, and illustrates a press die for automobile roof panel manufacturing.
Figure 4:
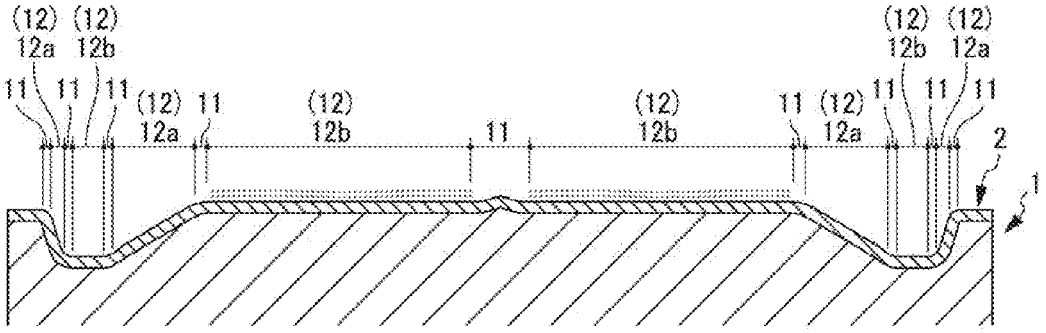
FIG. 4 is a cross-sectional view along a line "X-X" of FIG. 1A.
Figure 5:
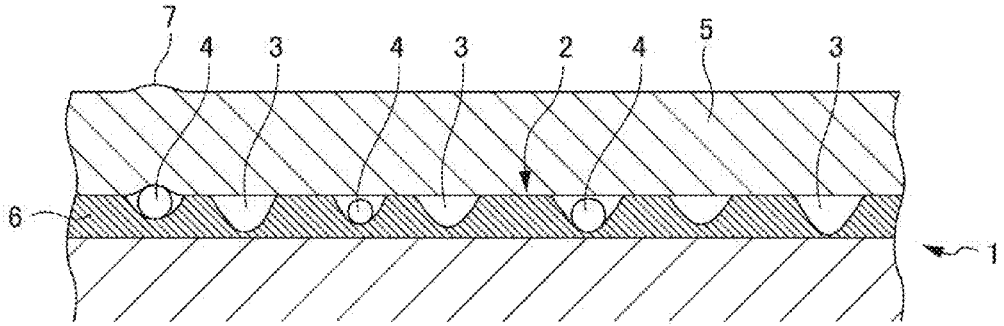
FIG. 5 is a view illustrating a state of carrying out a press process using a press die of the present invention.

FIGS. 3A and 3B are perspective views indicating a press die 1 of a second embodiment of the present invention, in which FIG. 3A illustrates a press die for a hood of an automobile, and FIG. 3B illustrates a press die for a roof panel of an automobile. FIG. 4 is a cross-sectional view taken along a line "X-X" of FIG. 3A. FIG. 5 is a view illustrating a state of carrying out a press process using a press die for sheet metal forming of the present invention.

Moreover, in explaining the following second embodiment, identical symbols are associated with identical constituent elements of the first embodiment, for which explanations will be omitted or simplified.

A press die 1 of the second embodiment, as illustrated in FIGS. 3A to 5, is a press die for sheet metal forming (hereafter referred to as a "press die" as well) 1 having a curved surface portion 11 and a substantially planar surface portion 12, and is a press die 1 placed and used so that a die surface 2 faces upwards. In a case of carrying out a press process using the press die 1 of the second embodiment, a sheet member of steel sheet or the like is placed on an upper side of the press die 1, a second press die (not illustrated) having a die surface of a shape corresponding to a shape of the die surface 2 on the press die 1 on an upper side of a sheet member is placed, and the sheet member is press-formed by moving the press die 1 and/or the press die 2 in a vertical direction.

Moreover, on a press die 1 of the present invention, the curved surface portion 11 indicates a part formed by a curved surface in which a radius of curvature of the die surface 2 is no more than 5 mm, and the substantially planar surface portion 12 indicates a part formed by a substantially planar surface in which a radius of curvature of the die surface 2 is larger than 5 mm.

The press die 1 of the second embodiment is formed with a multitude of concave portions 3 only on the die surface of the substantially planar surface portion 12. Furthermore, in the second embodiment, in a state in which a die 1 is positioned for a purpose of carrying out a press process, the substantially planar surface portion 12, as illustrated in FIG. 4, has a horizontal area 12*b* and a sloped area 12*a*. In addition, a multitude of concave portions 3 is formed on a die surface 2 of the horizontal area 12*b* in the substantially planar surface portion 12.

On the other hand, a multitude of concave portions 3 is not formed on a die surface 2 of the curved surface portion 11. Furthermore, a multitude of concave portions 3 is not formed in a vicinity of a border with the curved surface portion 11 in the substantially planar surface portion 12, and is not formed in a sloped area 12*a* in the substantially planar surface portion 12.

Moreover, a horizontal area 12*b* indicates an area to be placed in which, in the substantially planar surface portion 12, an inclination angle with respect to a horizontal surface of the substantially planar surface portion 12 is preferably less than 45 degrees, more preferably less than 30 degrees, and most preferably less than 20 degrees. A sloped area 12*a* indicates an area to be positioned so that an inclination angle with respect to a horizontal surface of the substantially planar surface portion 12 is preferably at least 45 degrees, more preferably at least 30 degrees, and most preferably at least 20 degrees.

Due to the press die 1 of the present invention having a multitude of concave portions 3 in a die surface 2 of a substantially planar surface portion 12, even in a case in which fine foreign matter 4 of iron dust and the like becomes caught in the die surface 2, because the foreign matter 4 enters concave portions 3, large concave and convex portions are not formed on a work 5 surface after a press process.

Moreover, as the foreign matter 4 adhering to the die surface 2, waste fibers or flakes of coating and the like can be given.

Furthermore, a multitude of concave portions 3 is not formed on the curved surface portion 11, but is only formed on the substantially planar surface portion 12. Foreign matter 4 of iron dust and the like do not adhere easily to the curved surface portion 11 with a small radius of curvature (of a large curvature) on the press die 1, but adhere easily to the substantially planar surface portion 12 with a large radius of curvature of a small curvature). In other words, foreign matter 4 of iron dust and the like generated at a time of press forming adheres relatively more on the substantially planar surface portion 12 than on the curved surface portion 11 on the press die 1. Therefore, by forming a multitude of concave portions 3 on only the substantially planar surface portion 12, it is possible effectively to prevent adverse effects to a work 5 surface by foreign matter 4 adhering to the die surface 2.

On the other hand, a multitude of concave portions 3 is not formed on the curved surface portion 11 on the press die 1. On the curved surface portion 11 on the press die 1, there are present parts of great curvature at the time of forming, that is, parts in which the word 5 has been significantly deformed at the time of press processing. As a result, in a case in which a multitude of concave portions 3 is formed on a curved surface portion 11 of great curvature, there is a risk that scratches (abrasions) may form on a work surface due to the presence of the multitude of concave portions 3. In this regard, in the press die 1 of the second embodiment, since a multitude of concave portions 3 is not formed on the die surface 2 on the curved surface portion 11, abrasions due to a multitude of concave portions 3 do not arise on a work surface formed by a press process.

Furthermore, a multitude of concave portions 3 is not formed on a sloped area 12*a* on a substantially planar surface portion 12, either. On the sloped area 12*a*, since the die surface 2 is placed so as to be sloped, foreign matter 4 of iron dust and the like slide off the die surface 2 easily, so it is difficult for the foreign matter 4 to adhere to the die surface 2 on the sloped area 12*a*. Therefore, even in a case in which a multitude of concave portions 3 is not formed on a die surface 2 on a sloped area 12*a*, it is difficult for concave and convex portions to arise on a surface of a work 5 after a press process due to foreign matter 4 of iron dust and the like.

In a case in which a multitude of concave portions 3 is net to be formed on a sloped area 12*a* on a substantially planar surface portion 12, a step of forming a multitude of concave portions 3 on the sloped area 12*a* becomes unnecessary, so it becomes possible to limit manufacturing costs of the press die 1.

Furthermore, in the press die 1 of the second embodiment, a roughness (Ry) of a die surface 2 on a substantially planar surface portion 12 on which a multitude of concave portions 3 has been formed is set to be in the range of 30 to 38 μm.

In the second embodiment, by setting a roughness (Ry) of a substantially planar surface portion 12 on which a multitude of concave portions 3 has been formed to be in the range of 30 to 38 μm, it is possible to prevent a lowering of surface precision of a work 5 on the substantially planar surface portion 12 after a press process due to a presence of a multitude of concave portions 3, while it is possible to prevent formation of large concave and convex portions on a surface of a work 5 after a press process, even in a case in which foreign matter 4 of relatively large size adhere to the die surface 2.

The press die 1, as illustrated in FIG. 5, preferably has a plated layer 6. Moreover, the effect is identical even when the present invention is applied to a die for which plating processing has not been performed.

Next, a press die surface of the second embodiment is explained with reference to FIGS. 6A to 6D. FIGS. 6A to 6D are views illustrating each step in a processing method of a press die surface of the second embodiment.

The processing method of a press die surface of the second embodiment includes: 1) a plating processing step, 2) a masking step, 3) a shot blast process step, and 4) a polishing process step.

1) Plating Processing Step

Figure 6A:
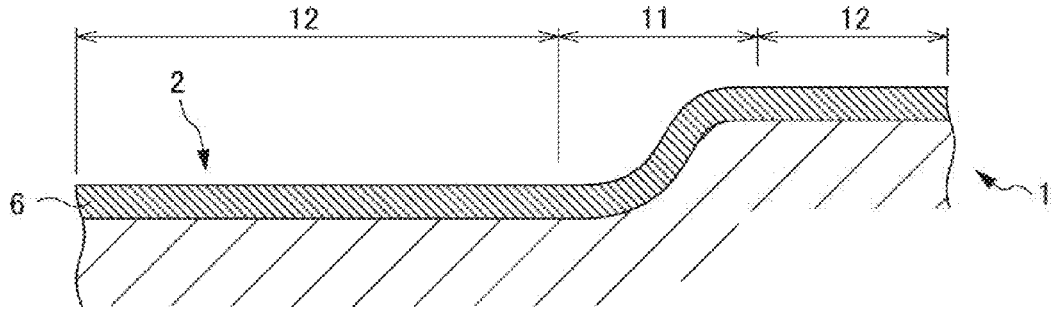
FIG. 6A is a view illustrating a plating step in a processing method of a press die surface of a second embodiment.

First, plating processing is performed to a die surface 2, which is a contact surface with a work on a press die 1 (see FIG. 6A). The plating processing is carried out with a method similar to that of the first embodiment.

2) Masking Processing Step

Figure 6B:
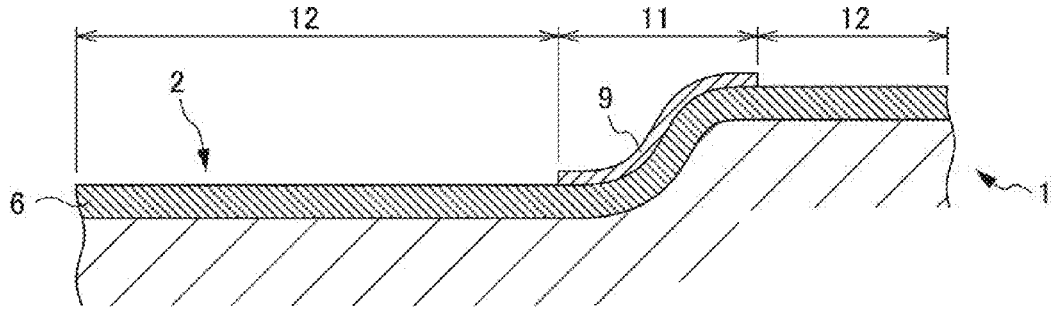
FIG. 6B is a view illustrating a masking step in a processing method of a press die surface of the second embodiment.

Next, masking processing is performed to a curved surface portion 11 and a boundary area of a curved surface portion 11 and a substantially planar surface portion 12, on a die surface 2 to which plating processing has been performed (see FIG. 6B). Masking processing, for example, can be carried out by adhering a masking material 9 to a curved surface portion 11 and a boundary area of a curved surface portion 11 and a substantially planar surface portion 12, on the die surface 2. As a masking material 9, aluminum tape, vinyl tape, or the like can be given.

By performing the masking process, in a shot blast step to be described later, it is possible to prevent a multitude of concave portions 3 from being formed on the curved surface portion 11. In a case of performing masking processing to the curved surface portion 11 and the border area of the curved surface portion 11 and the substantially planar surface portion 12, it is preferable that the masking processing be performed to an area approximately 10 mm from the boundary of the curved portion 11 and the substantially planar surface portion 12 on the substantially planar surface portion 12.

Moreover, the masking processing, in the present embodiment, is performed to the curved surface portion 11 and the boundary area of the curved surface portion 11 and the substantially planar surface portion 12, but performing at least to the curved surface portion 11 is acceptable.

3) Shot Blast Process Step

Figure 6C:
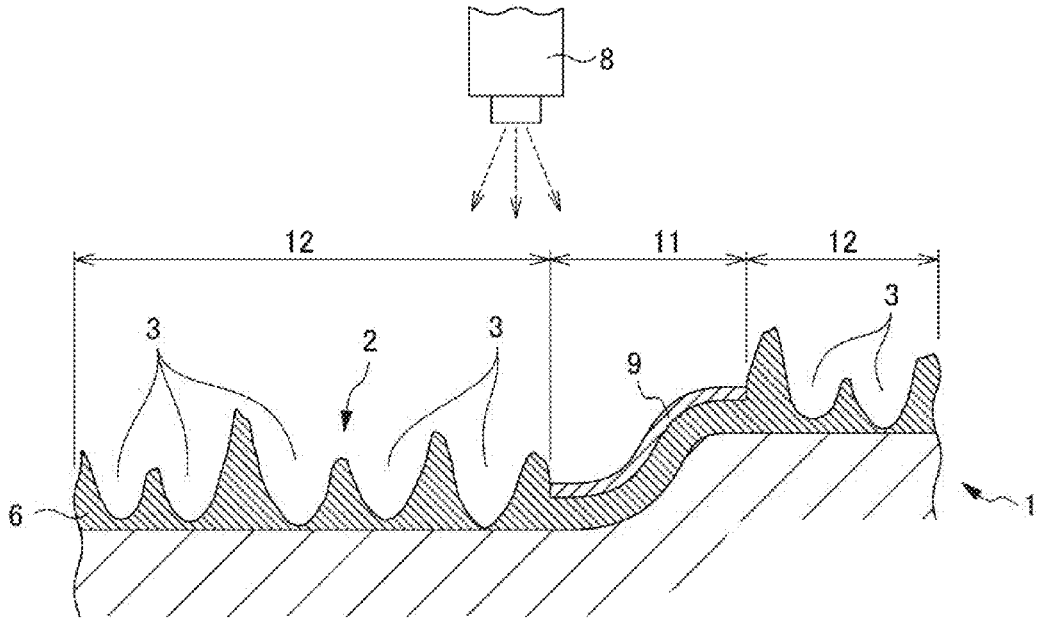
FIG. 6C is a view illustrating a shot blast process step in a processing method of a press die surface of the second embodiment.

Next, on a substantially planar surface portion 12 on a die surface 2 to which plating processing has been performed, a shot blast process is performed with a similar method to that of the first embodiment (see FIG. 6C). By a shot blast process, a multitude of concave and convex portions is formed or a substantially planar surface portion 12 on a die surface 2.

Moreover, since masking processing is performed to a curved surface portion 11 of the press die 1 to which a shot blast process has been performed, and to a boundary area of the curved surface portion 11 and the substantially planar surface portion 12, even if shot blasting media is sprayed on the curved surface portion 11 and on the boundary area of the curved surface portion 11 and the substantially planar surface portion 12, a multitude of concave and convex portions is not formed on the area. Here, in a case in which masking processing is not performed to the curved surface portion 11, a multitude of concave portions 3 is formed on the curved surface portion 11 as well, while, by a shot blast process, there is a risk in that a shape of the curved surface portion 11 with a small radius of curvature may change.

Furthermore, in the second embodiment, a shot blast process is not performed to a sloped area 12*a* on the substantially planar surface portion 12, and a multitude of concave portions 3 is not formed on the die surface 2 on the sloped area 12*a* (see FIG. 4). In a case in which a shot blast process is performed to the sloped area 12*a* on the substantially planar surface portion 12, shot blasting media is not uniformly sprayed on the sloped die surface 2, and there is a risk in that a depth of a multitude of concave portions 3 formed on the die surface 2 may be nonuniform.

A roughness (Ry) of the die surface 2 on the substantially planar surface portion 12 on which a multitude of concave portions 3 has been formed after a shot blast process, from a perspective of setting a roughness (Ry) on a die surface 2 after a polishing process step (after final finishing) to be 30 to 38 μm, should preferably be 30 to 43 μm. In other words, in a polishing step after a shot blast process, approximately 5 μm of the surface is planed from the overall die.

4) Polishing Process Step

Figure 6D:
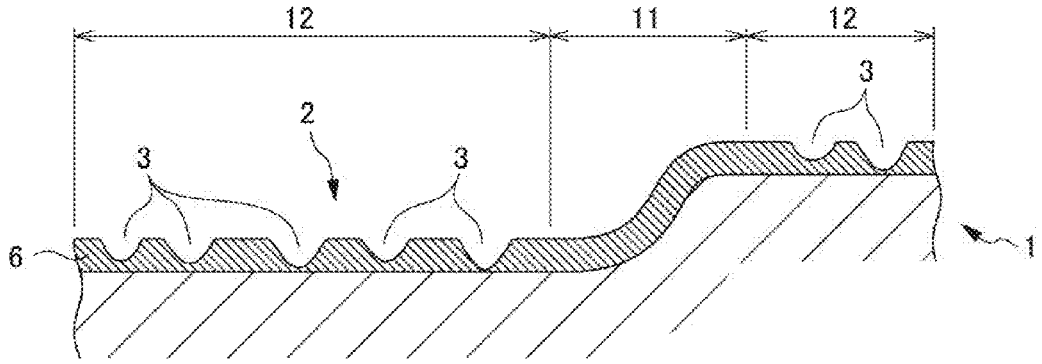
FIG. 6D is a view illustrating a polishing process step in a processing method of a press die surface of the second embodiment.

Next, to the die surface 2 of the substantially planar surface portion 12 on which a multitude of concave portions 3 has been formed by a shot blast process, a polishing process is performed with a similar method to that of the first embodiment (see FIG. 6D).

According to the processing method of the press die surface of the second embodiment, since a multitude of concave portions 3 having a prescribed depth is formed on the die surface 2 of the substantially planar surface portion 12 on the press die 1 having a curved surface portion 11 and a substantially planar surface portion 12, even in a case in which such foreign matter 4 as iron dust and the like adhere to the die surface 2, it is possible to obtain a press die 1 which can maintain a high non-defective product rate of works 5 after a press process.

Furthermore, after performing plating processing on the die surface 2, by performing a shot blast process, plating hardness is increased and, consequently, wear-resistance of the press die 1 is increased.

In addition, according to the processing method of the press die surface of the second embodiment, since a shot blast process is performed after masking processing is performed at least to toe curved surface portion 11, a multitude of concave portions 3 is not formed on the curved surface portion 11, and it is possible to form a multitude of concave portions 3 on only the substantially planar surface portion 12.

Moreover, when a shot blast process is performed in order to form a multitude of concave portions 3 on the curved surface portion 11, which is a region of a small radius of curvature of the press die 1, this can have the opposite effect of marring the outer shape of the press die 1, but by way of the press die 1 of the second embodiment, it is possible to prevent damage to the form of this press die 1.

Furthermore, according to the processing method of the press die surface of the second embodiment, since the press die has a plated layer by having a plating processing step, a multitude of concave portions is formed on the plated layer part on the die surface. Therefore, in a case in which a die is used repeatedly in a press process and a roughness (Ry) of a die surface becomes outside a range of 30 to 38 μm, it is possible easily to form again a multitude of concave portions only on a substantially planar surface portion on the press die by removing a plated layer, and performing re-plating processing, masking processing, a shot blast process, and a polishing process to recover a roughness (Ry) of the die surface.

In other words, according to a press die for which surface processing has been applied by the processing method of the press die surface of the second embodiment, it is possible easily to carry out maintenance for preserving a roughness (Ry) of a die surface to within a prescribed range.

In this maintenance, aside from management of a value of roughness (Ry), it is preferable to carry out maintenance with the number of times of press and shot blasting, operating time of a die, and frequency of dirt getting caught as control items.

Furthermore, the shot blast process to the press die surface in the second embodiment is performed only to the flat substantially planar surface portion in which presence of deformities 7 after a press process is easily visually recognizable, that is to regions of shallow curvature at a time of a press process. Regions of shallow curvature are such that the presence of deformities 7 after a press process is easily visually recognized, while on the other hand, the force applied to the die surface 2 at a time of a press process is relatively small compared to regions of great curvature. As a result, by a multitude of concave portions 3 being formed only or the substantially planar surface portion 3 of shallow curvature, wear on the form of the multitude of concave portions 3 is lessened, and it is possible to lengthen a period of use of a press die.

The above-described press die to which the processing method of the second embodiment has been applied may preferably be used for forming components having curved surface portions and substantially planar surface portions, and in particular, for forming various outer panel components configuring a vehicle body and the like. Furthermore, an identical effect was obtained whether the outer panel component was iron or aluminum.

Figure 7:
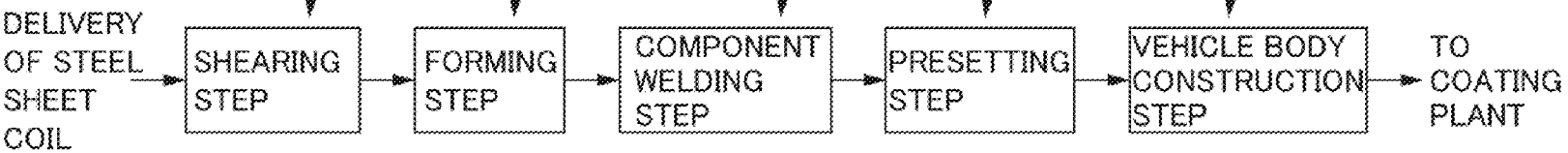
FIG. 7 is a flow diagram illustrating an embodiment of a manufacturing method of a vehicle body of the present invention.
Figure 8:
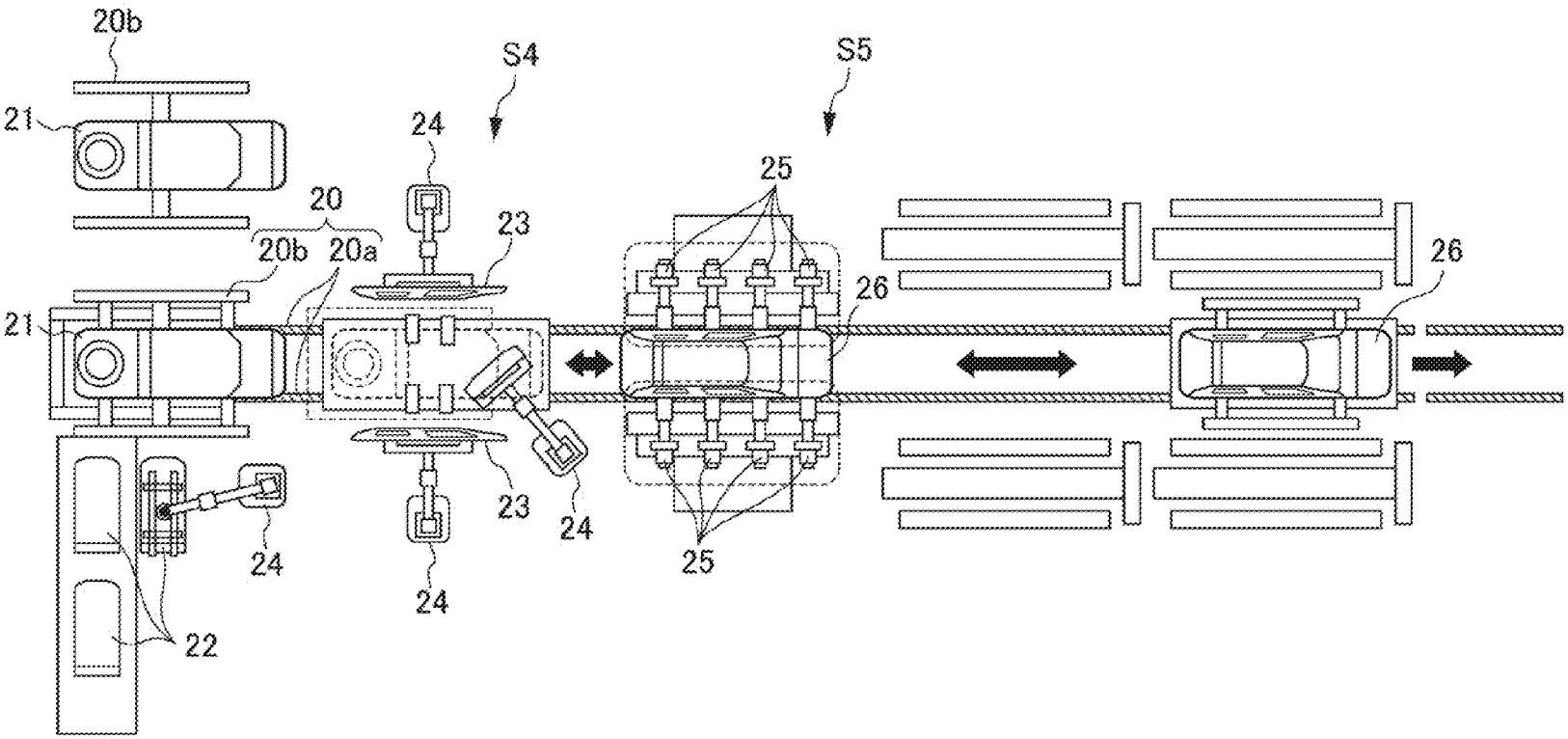
FIG. 8 is a diagram illustrating an outline of a preset step and a vehicle construction step in a manufacturing method of a vehicle body of the present invention.
Figure 9A:
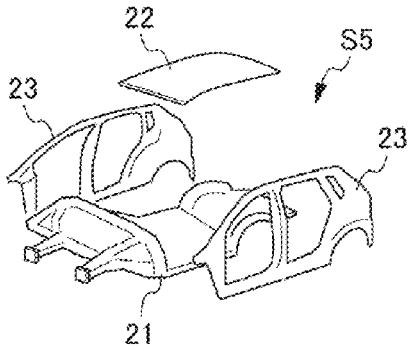
FIG. 9A is a diagram illustrating an example of a vehicle body construction step in a manufacturing method of a vehicle body of the present invention.
Figure 9B:
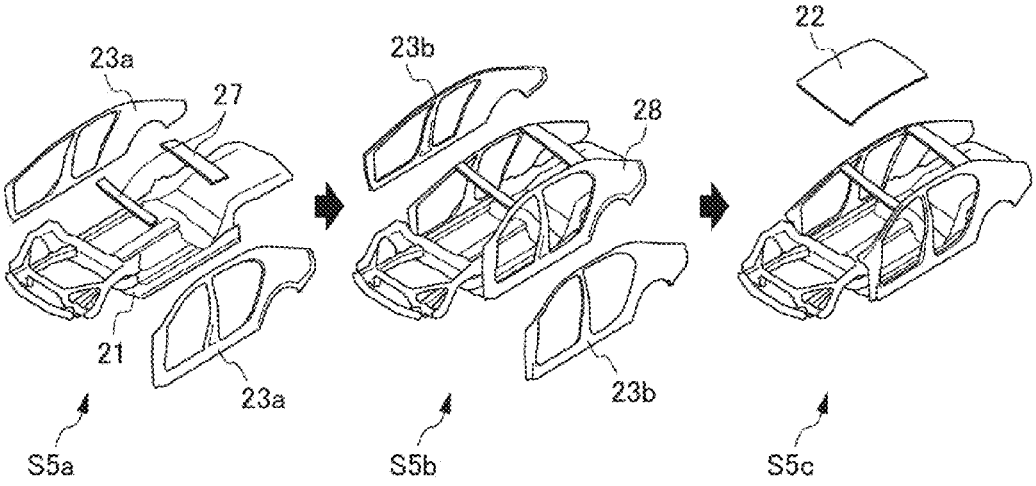
FIG. 9B is a diagram illustrating another example of a vehicle body construction step in a manufacturing method of a vehicle body of the present invention.

Next, a preferable embodiment of a manufacturing method of a vehicle body using a press die of the present invention is explained with reference to FIGS. 7, 8, 9A and 9B. FIG. 7 is a flow diagram illustrating an embodiment of a manufacturing method of a vehicle body of the present invention. FIG. 8 is a diagram illustrating an outline of a presetting step and a vehicle construction step in a manufacturing method of a vehicle body of the present invention. FIG. 9A is a diagram illustrating an example of a vehicle body construction step in a manufacturing method of a vehicle body of the present invention. FIG. 9B is a diagram illustrating another example of a vehicle body construction step in a manufacturing method of a vehicle body of the present invention.

The present embodiment is a manufacturing method of a vehicle body of the present invention applied to a manufacturing method of a vehicle body of an automobile.

The present embodiment includes a forming step S2 of forming an outer panel component of a vehicle body using a press die of the present invention, and a welding step S3 of welding a plurality of outer panel components formed in the forming step.

More particularly, a manufacturing method of a vehicle body of an automobile of the present embodiment, as illustrated in FIGS. 7 and 8, has a shearing step S1 of shearing a coil of sheet steel; a forming step S2 of forming a shape of various outer panel components configuring a vehicle body by a press die in which a steel sheet has been sheared in the shearing step S1; a welding step (hereinafter, also referred to as a "component welding step") S3 of manufacturing each component of a vehicle body by welding a plurality of types of various outer panel components formed in the forming step S2; a presetting step S4 of positioning each component formed in the component welding step S3 at a prescribed location; and a vehicle body construction step S5 of forming a vehicle body by constructing each component positioned at a prescribed location in the presetting step S4.

Below, each step thereof is explained.

In the shearing step S1, a coil of sheet steel delivered to a vehicle body plant is cut off into a prescribed form by shearing.

In the forming step S2, the pulled flat steel sheet in the shearing step S1 is formed into a shape of various outer panel components configuring a vehicle body by a press apparatus (for example, a tandem press apparatus or the like) in the public domain using the press die. In the present embodiment, the press die 1, which has had the processing method of the press die surface of the present invention described above in this forming step performed thereto, is used, manufacturing various outer panel components configuring a vehicle body.

Moreover, the press die to which the processing method of the press die surface of the present invention has been performed is especially preferably used in press forming of a roof panel, a side panel, a hood, such large pressed components as floor panels and the like, and various press components configuring these large pressed components. Furthermore, preferably usage is made in press forming of small pressed components of reinforced members and the like. Regarding forming of these small components, press forming using a generic press die other than the present invention is also acceptable.

In the component welding step S3, a plurality of types of various outer panel components formed in the forming step S2 are welded, and each component configuring the vehicle body is manufactured. Welding in the component welding step S3 is carried out by a plurality of welding robots.

As components formed in the component welding step S3, underbodies, side bodies, doors, roofs, hoods, trunk lids, and the like can be given.

In the present embodiment, press components configuring each of these components are all formed using a die for sheet metal forming of the present invention.

In the presetting step S4, as illustrated in FIG. 8, each component manufactured in the component welding step S3 is positioned placed at a prescribed position.

In the presetting step S4, first, an underbody 21 is placed on a carriage 20*b* configuring a transfer mechanism 20. The transfer mechanism 20 includes a rail 20*a* and a carriage 20*b* placed movably on the rail 20*a*.

Next, in relation to the underbody 21 placed on the carriage 20*b*, each of the components of the roof 22, the side body 23, and the like are positioned placed at a prescribed position by a robot arm 24. Each component is moved in a state positioned at a prescribed location on the carriage 20*b*, and sent to a vehicle body construction step S5.

In a vehicle body construction step S5, each component in a state of being positioned in a prescribed location in the presetting step S4 is welded, and a vehicle body (white body) 26 is constructed. Welding of each component in the vehicle construction step S5, as illustrated in FIG. 6, is carried out by a welding robot 25.

In this manner, a vehicle body (white body) 26 before performing a coating process thereto is manufactured.

The vehicle body (white body) 26, manufactured after the vehicle body construction step is delivered to a coating plant, and various coating processing is performed to the vehicle body (white body) in a coating step (not illustrated).

Moreover, the vehicle body construction step S5 constructing the white body 26, as illustrated in FIGS. 8 and 9A, is not limited to a vehicle construction step S5 of a monocoque method of constructing each component of the underbody 21, roof 22, side body 23, and the like, configuring the white body 26, at one time. The vehicle construction step S5, as illustrated, for example, in FIG. 9B, may be a vehicle body construction step S5 of an inner framework method, composed of a step S5*a* of constructing an inner framework 28 configured by components of an underbody 21, an inner-side side body 23*a*, a cross member 27, and the like; a step S5*b* of mounting thereafter an exterior side body 23*b* and the like on the inner framework 28; and a step S5*c* of mounting thereafter a roof 22 and the like additionally on the inner framework 28 on which toe exterior side body 23*b* and the like have been mounted.

The vehicle body construction step S5 of this inner framework method is used in manufacturing mainly high-grade vehicle types.

The press die of the die for sheet metal forming of the present invention is also preferably used in manufacturing various outer panel components configuring components used in the vehicle body construction step S5 of the above-mentioned monocoque method, and any outer panel components of any various outer panel components configuring components used in each step (S5*a*, S5*b*, and S5*c*) in the vehicle body construction step S5 of the above-mentioned inner framework method.

According to the manufacturing method of a vehicle body of the present embodiment, by using the press die 1 of the die for sheet metal forming of the present invention to which the processing method of the present invention has been applied in a forming step, various outer panel components after a press process become of a high non-defective product rate and, consequently, it becomes possible to increase a quality of vehicles manufactured after a welding process.

Furthermore, since a non-defective product rate of outer panel components after a press process is high, that is, a quantity of defective products requiring repair work is low, it becomes possible to reduce repair man-hours, while increasing a manufacturing efficiency of vehicle bodies.

Moreover, a vehicle body to which the manufacturing method of a vehicle body of the present invention is applied is not limited to the above-mentioned automobile, but it is possible to name bicycles, ATVs, outboard motors, and the like. In particular, metallic components configuring these vehicle bodies overall can be applied thereto.

Furthermore, the press die of the present invention is used in forming of outer panel components of vehicle bodies, and is preferably used in forming of works configuring various industrial products in cogeneration systems, outer panel components and covers of airplanes, and the like. As materials of these works, iron, aluminum, or the like can be given.

EMBODIMENTS

Next, the present invention is described in more detail based on the embodiment of the present invention, but the present invention is not limited to this.

Embodiment 1

By the processing method of the above-described press die surface, surface processing is performed to a press die, and the press die of the first embodiment is manufactured.

Plate Processing

As plating processing, plating processing by a processing method of industrial chrome plating, which is common electroplating, is adopted, and plating processing is performed to a die surface by a plating processing method in the public domain. A thickness of a plated layer formed on a die surface is 20 μm.

Masking Process

A radius of curvature on a die surface was measured, and a curved surface portion which was of a radius of curvature of no more than 5 mm, and a substantially planar surface portion which was of a radius of curvature of greater than 5 mm, were each identified. A masking process was performed using an aluminum tape on a curved surface portion. Measurement of a radius of curvature for a die surface was measured using an R-gauge.

Shot Blast Process

A shot blast process was performed to a die surface to which the masking process was performed to a curved surface portion thereof.

In the shot blast process, glass beads of particle diameter 0.3 mm were used as shot blasting media, and were directly sprayed on a die surface with a shot pressure of 1.2 MPa. A roughness (Ry) of a die surface after the shot blast process was 44 μm.

Polishing Process

A polishing process was performed on a die surface to which a multitude of concave portions was formed by the shot blast process. The polishing process was carried out using 600 to 800 grain sandpaper, and an average depth of the multitude of concave portions formed on the die surface was adjusted to be 35 μm (see point a of FIG. 12).

A roughness (Ry) of a die surface after the above-mentioned shot blast process and a roughness (Ry) of the die surface after the polishing process were measured using the <Measurement Method of Roughness of a Die Surface> indicated in the following.

Measurement Method of Roughness of a Die Surface

The roughness measurement, using surface roughness measuring instrumenty E-30A or E-35B manufactured by Tokyo Seimitsu Co., Ltd. (ACCRETECH) determined a roughness (Ry) of a die surface after the shot blast process and a roughness (Ry) of a die surface after polishing process.

Figure 10:
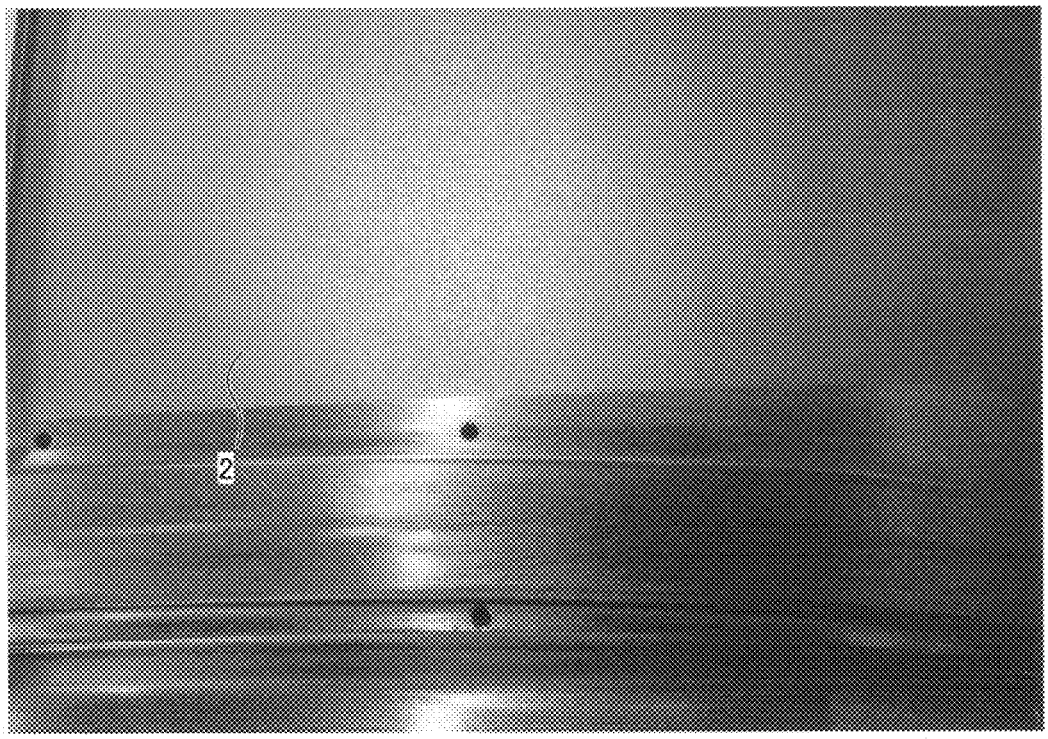
FIG. 10 is a diagram illustrating an aspect of a die surface of a press die of the first embodiment.

In this manner, the press die of the first embodiment was obtained. An aspect of a die surface of the obtained press die of the first embodiment is illustrated in FIG. 10. It can be seen that a multitude of minute concave and convex portions is formed on a die surface 2 of the press die of the first embodiment, and that a luster of the die surface has been lost.

Embodiment 2

Figure 12:
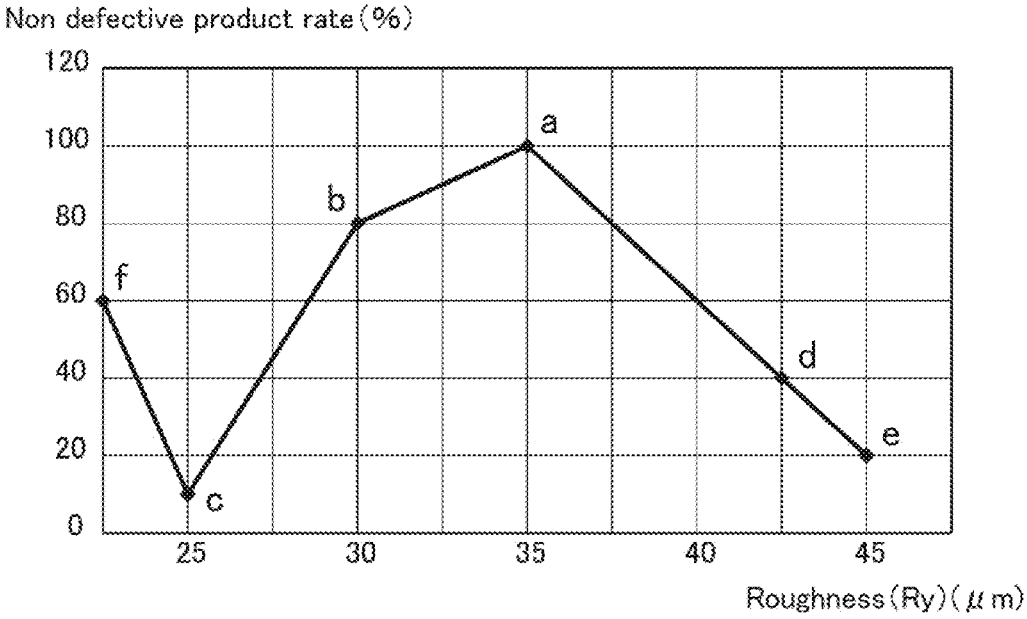
FIG. 12 is a diagram illustrating a rate of non-defective works formed using press dies of each embodiment and comparative example.
Figure 13:
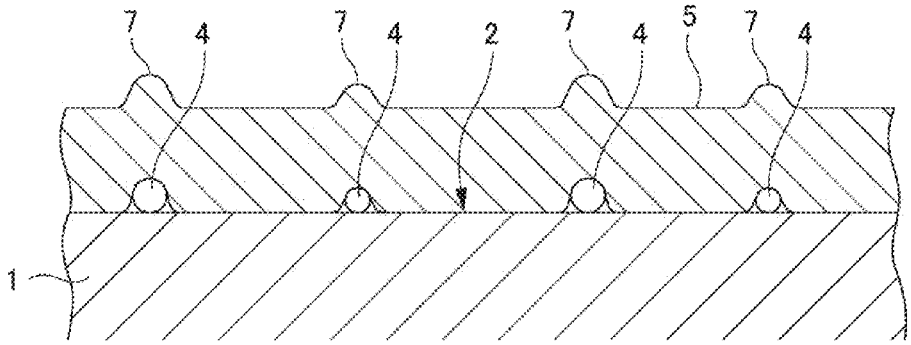
FIG. 13 is a view illustrating a state of carrying out a press process using a conventional press die.

In the shot blast process in the first embodiment, using glass beads of particle diameter 0.3 mm, aside from adjusting a roughness (Ry) of a die surface after a polishing process to be 30 μm, a press die of the second embodiment was obtained with a similar method to that of the first embodiment (see point b of FIG. 12).

Comparative Example 1

In the shot blast process in the first embodiment, using glass beads of particle diameter 0.3 mm, aside from adjusting a roughness (Ry) of a die surface after a polishing process to be 25 μm, a press die of comparative example 1 was obtained with a similar method to that of the first embodiment (see point a of FIG. 12).

Comparative Example 2 the shot blast process in the first embodiment, using glass beads of particle diameter 0.3 mm, aside from adjusting a roughness (Ry) of a die surface after a polishing process to be 43 μm, a press die of comparative example 2 was obtained with a similar method to that of the first embodiment (see point d of FIG. 12).

Comparative Example 3

In the shot blast process in the first embodiment, using glass beads of particle diameter 0.3 mm, aside from adjusting a roughness (Ry) of a die surface after a polishing process to be 45 μm, a press die of comparative example 3 was obtained with a similar method to that of the first embodiment (see point e of FIG. 12).

Comparative Example 4

Figure 11:
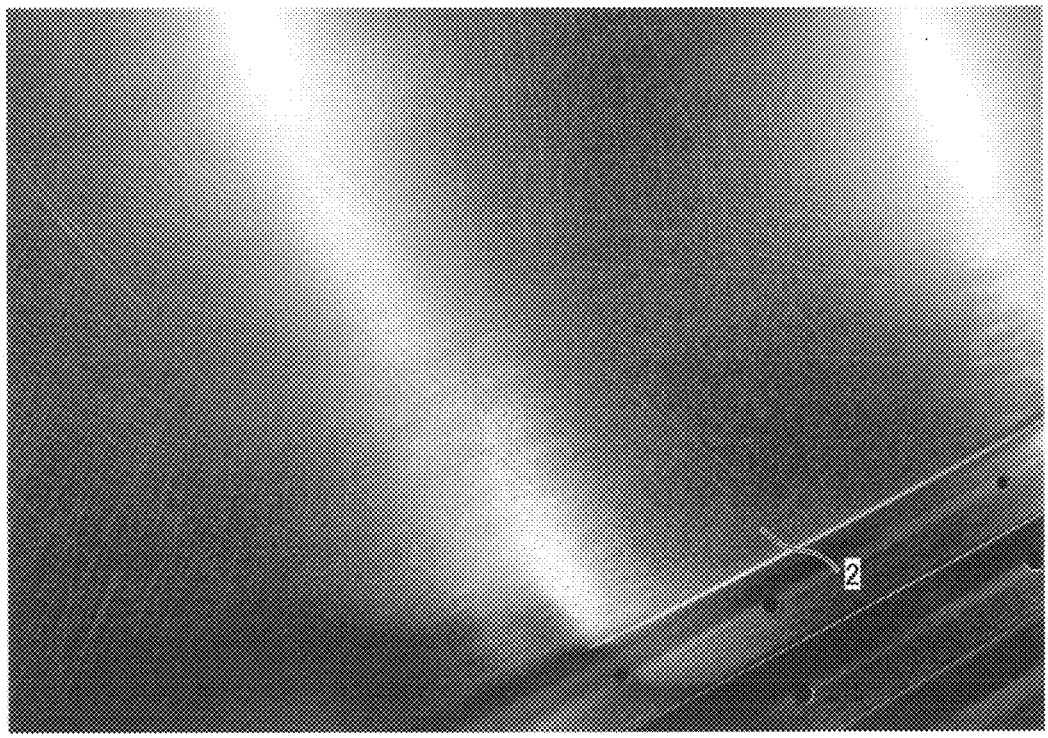
FIG. 11 is a diagram illustrating an aspect of a die surface of a press die of comparative example 4.

A press die of comparative example 4 was obtained by carrying out only plating processing in the first embodiment. Concave and convex portions were not formed on a die surface of comparative example 4, and a roughness (Ry) of the die surface was 0 μm (see point f of FIG. 12). An aspect of a die surface of a press die of the obtained comparative example 4 is illustrated in FIG. 11. Concave and convex portions were not formed on the die surface 2 of comparative example 4, and it can be seen that the die surface has luster.

Evaluation

A press process of works was carried out repeatedly (5000 times) using press dies of the first embodiment, the second embodiment, and comparative example 1 to comparative example 4, and non-defective product rates of press-formed works thereof were measured.

The non-defective product rate was obtained by measuring a height of deformities formed on press-formed works, assuming those with deformities of height less than 10 μm to be non-defective, and dividing the non-defective product quantity by the total number of times that the press process was carried out.

The results are illustrated in FIG. 12.

As illustrated in FIG. 12, a non-defective product rate for works for which the press process was carried out using a press die of the first embodiment and the second embodiment was at least 80%, and even when the press process was carried out repeatedly, it can be seen that a high non-defective product rate is maintained.

On the other hand, for works for which the press process was carried out using the press dies of comparative example 1 to comparative example 4, every non-defective product rate was less than 80%, which was low, and it can be seen that by repeatedly carrying out the press process, the non-defective product rate greatly decreased.

Embodiment 3

By performing plating processing, a shot blast process, and a polishing process by way of a method similar to that of the first embodiment to a substantially planar surface portion on a press die having a substantially planar surface portion of which a radius of curvature of a die surface was 15 mm, a press die of a third embodiment was obtained in which a multitude of concave portions was formed on a die surface.

Embodiment 4

Except for having used a press die including a substantially planar surface portion in which a radius of curvature of a die surface was 10 mm, with a method similar to that of the third embodiment, a press die of a fourth embodiment was obtained in which a multitude of concave portions was formed on a die surface.

Comparative Example 5

Except for having used a press die including a curved surface portion in which a radius of curvature of a die surface was 5 mm, with a method similar to that of the third embodiment, a press die of comparative example 5 was obtained in which a multitude of concave portions was formed on a die surface.

Comparative Example 6

Except for having used a press die including a curved surface portion in which a radius of curvature of a die surface was 3 mm, with a method similar to that of the third embodiment, a press die of comparative example 6 was obtained in which a multitude of concave portions was formed on a die surface.

Press processes of works using press dies of the third and fourth embodiments and comparative examples 5 and 6 were carried out, and surface conditions of press-formed works were evaluated. Evaluation of surface conditions were carried out by visually observing surfaces of press-formed works using a magnifying glass. Evaluation was carried out by way of the following four grades. The results are indicated in the following Table 1.

Evaluation Standards

A: No Blemishes: There are no blemishes on the work surface, which is in an exceptionally good state.

B: Slight Blemishes: Although there are slight blemishes formed on the work surface, it is in a good state.

C: Blemishes: Blemishes are formed on the work surface, which is in a rather defective state.

D: Many Blemishes: There are many blemishes formed on the work surface, which is in a defective state.

TABLE 1

| | Radius of curvature (mm) | Surface condition. |
|---|---|---|
| Embodiment 3 | 15 | A |
| Embodiment 4 | 10 | A |
| Comparative Example 5 | 5 | C |
| Comparative Example 6 | 3 | D |

As illustrated in Table 1, it can be seen that the press-formed works using a press die of the third and fourth embodiments, on which a multitude of concave portions has been formed on a die surface on a substantially planar surface portion of a radius of curvature greater than 5 mm, each have a favorable surface condition.

On the other hand, it can be seen that the works that were press-formed using a press die of comparative examples 5 and 6, on which a multitude of concave portions had been formed on a die surface on a curved surface portion of radius of curvature no greater than 5 mm, have blemishes formed on a work surface, and that a surface condition of press-formed works is defective. This can be attributed to the multitude of concave portions formed on a curved surface portion of a press die or comparative examples 5 and 6 generating abrasions on a curved surface portion of the work at a time of the press process.

The invention claimed is:

1. A surface processing method of a press die for sheet metal forming, said press die having a die surface comprising a curved surface portion having a radius of curvature of no greater than 5 mm, and a substantially planar surface portion having a radius of curvature of greater than 5 mm, wherein the method comprises:

a plating process step of forming a plated layer on the die surface;

a shot blast process step of forming a multitude of concave portions by performing a shot blast process from above a plated layer on the die surface only in the substantially planar surface portion but not in the curved surface portion; and a step of adjusting a roughness in the die surface of the substantially planar surface portion by performing a polishing process on the plated layer after the shot blast process step on the die surface in which the multitude of concave portions has been formed to adjust the roughness to be 30 to 38 μm, wherein in a state in which the press die is positioned for a purpose of carrying out a press process, the substantially planar surface portion comprises a horizontal area and a sloped area, wherein the multitude of concave portions has been formed on the die surface of the horizontal area in the substantially planar surface portion, and wherein the multitude of concave portions has neither been formed in the sloped area nor in a vicinity of a border with the curved surface portion in the substantially planar surface portion.

2. The surface processing method according to claim 1, further comprising:

a masking step of performing, before the shot blast process step, masking processing on the curved surface portion.

3. The surface processing method according to claim 2, comprising a further step of:

performing, before the masking step, plating processing on a surface of the press die.

4. A press die for sheet metal forming having had surface processing performed thereto by a processing according to claim 1.

* * * * *